US009186013B1

(12) United States Patent
Letney

(10) Patent No.: US 9,186,013 B1
(45) Date of Patent: Nov. 17, 2015

(54) UNITY HEART ASSEMBLY

(71) Applicant: Michael James Letney, Tulsa, OK (US)

(72) Inventor: Michael James Letney, Tulsa, OK (US)

(73) Assignee: Michael James Letney, Tulsa, OK (US)

( * ) Notice: Subject to any disclaimer, the term of this patent is extended or adjusted under 35 U.S.C. 154(b) by 149 days.

(21) Appl. No.: 13/944,536

(22) Filed: Jul. 17, 2013

Related U.S. Application Data

(63) Continuation-in-part of application No. 29/449,773, filed on Mar. 15, 2013, now Pat. No. Des. 715,683.

(51) Int. Cl.
*A47G 33/00* (2006.01)
*B44C 5/00* (2006.01)

(52) U.S. Cl.
CPC .. *A47G 33/00* (2013.01); *B44C 5/00* (2013.01)

(58) Field of Classification Search
CPC ..... A47G 33/00; A47G 33/02; A47G 33/08; B44C 5/00
USPC ..... 428/7–9, 11, 18–20, 542.2
See application file for complete search history.

(56) References Cited

U.S. PATENT DOCUMENTS

| | | | | |
|---|---|---|---|---|
| 274,638 | A | 3/1883 | Mould | |
| 2,355,154 | A | 8/1944 | Goudreau | |
| 2,533,778 | A | 6/1946 | Eckhardt | |
| 5,628,413 | A * | 5/1997 | Lu et al. | 211/13.1 |
| D619,926 | S | 7/2010 | Letney | |
| 8,038,309 | B2 | 10/2011 | Yang | |
| 8,418,344 | B1 | 4/2013 | Letney | |
| 2010/0087120 | A1 * | 4/2010 | Norman | 446/297 |

OTHER PUBLICATIONS

Artmajeur "Four sided heart shaped plant stand", 2012, p. 1-3. Accessed on Jul. 15, 2015 at http://www.artmajeur.com/en/art-gallery/gallery/1321360/5988037/four-sided-heart-shaped-plant-stand?login=macsart&cSlug=abstract-metal-art-sculptures&cld=1321360,%202012,%20p.%201.*

* cited by examiner

*Primary Examiner* — Mark Ruthkosky
*Assistant Examiner* — Julia L Rummel
(74) *Attorney, Agent, or Firm* — Head, Johnson & Kachigian, P.C.

(57) ABSTRACT

A multi-piece ceremonial sculpture that when assembled creates a symbol for unity during a wedding, anniversary, or union ceremony. The method of assembling the sculpture is to insert a first bent-shaped heart piece onto a base and then insert a second bent heart-shaped piece onto the base each by means of pegs and peg holes. The first bent heart-shaped piece and the second bent heart-shaped piece may be fastened together through a hinge connection. Finally, a pin may be inserted through the hinge connection of the first bent heart-shaped piece and the second bent heart-shaped piece to secure the two pieces together. The completed assembly resembles one three-dimensional heart, yet maintaining the identities of each individual heart symbolizing two hearts coming together into a union.

5 Claims, 5 Drawing Sheets

UNITY HEART ASSEMBLY

CROSS REFERENCE TO RELATED APPLICATIONS

This application is a continuation-in-part of U.S. Design patent application Ser. No. 29/449,773 entitled "Unity Heart Assembly", filed Mar. 15, 2013, which is incorporated herein by reference in its entirety.

BACKGROUND OF THE INVENTION

1. Field of the Invention

The present invention is directed to a method of assembling a multi-piece ceremonial sculpture and to a multi-piece ceremonial sculpture. More specifically, the present invention is a method of assembling a three-dimensional heart-shaped sculpture, that once assembled establishes a symbol of unity during a wedding or union ceremony.

2. Description of the Related Art

Various ceremonial rituals such as candles and other devices are commonly used to commemorate weddings, unions, or other various types of ceremonies. During a ceremony, two people in unison commence some sort of action such as lighting a candle, or filling a bottle with sand in order to show their union.

Current existing art also includes the assembly of a cross-like sculpture during a ceremony to celebrate a union for example, see Applicant's Method of Assembling a Multi-Piece Sculpture (U.S. Pat. No. 8,418,344). However, the assembly of a heart shaped sculpture represents two hearts of two different people coming together to form one heart in unison. Such an assembly is desired in the art and advantageous over the prior designs and commemorative rituals due to its unique nature and symbolism.

SUMMARY OF THE INVENTION

The present invention is directed to a method of assembly of a ceremonial multi-piece heart-shaped sculpture and to a multi-piece ceremonial sculpture.

During wedding, anniversary, and union ceremonies, it is becoming increasingly popular to celebrate with a unity ritual in order to symbolize the joining of two people, families, or business entities. There are many different types of rituals and devices that can be used during wedding ceremonies or other types of celebrations. A heart is often used as a symbol of love and unity during ceremonies. The unity heart, when assembled during a wedding, union, or celebration ceremony creates and affirms the idea of love and unity between two people and/or families joining together.

A first embodiment provides a method of assembling a ceremonial multi-piece sculpture, composed of two bent heart-shaped pieces. The two bent heart-shaped pieces align with one another through a hinge connection and then each are fitted onto a base by way of pegs and peg holes. A topper serves to secure the assembly from the top by acting as a pin sliding through the hinge connection of both bent shaped heart pieces.

One of the bent heart-shaped pieces features ornamental designs along the main body of the heart. This piece may represent the bride, or female counterpart in a union or wedding. The other bent, heart-shaped piece is plain, without ornamental design and may represent the groom, or male counterpart, in a union or wedding.

Once the two bent, heart-shaped pieces come together, and are secured onto the base, the assembly resembles a single, three-dimensional heart, yet maintaining the identities of each individual heart (one plain and one with an ornamental design) symbolizing two hearts coming together into a union.

DETAILED DESCRIPTION OF THE INVENTION

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The embodiments contained herein provide for a method or process to assemble a ceremonial three-dimensional, heart shaped sculpture, as well as for a multi-piece ceremonial sculpture.

Figure 1:
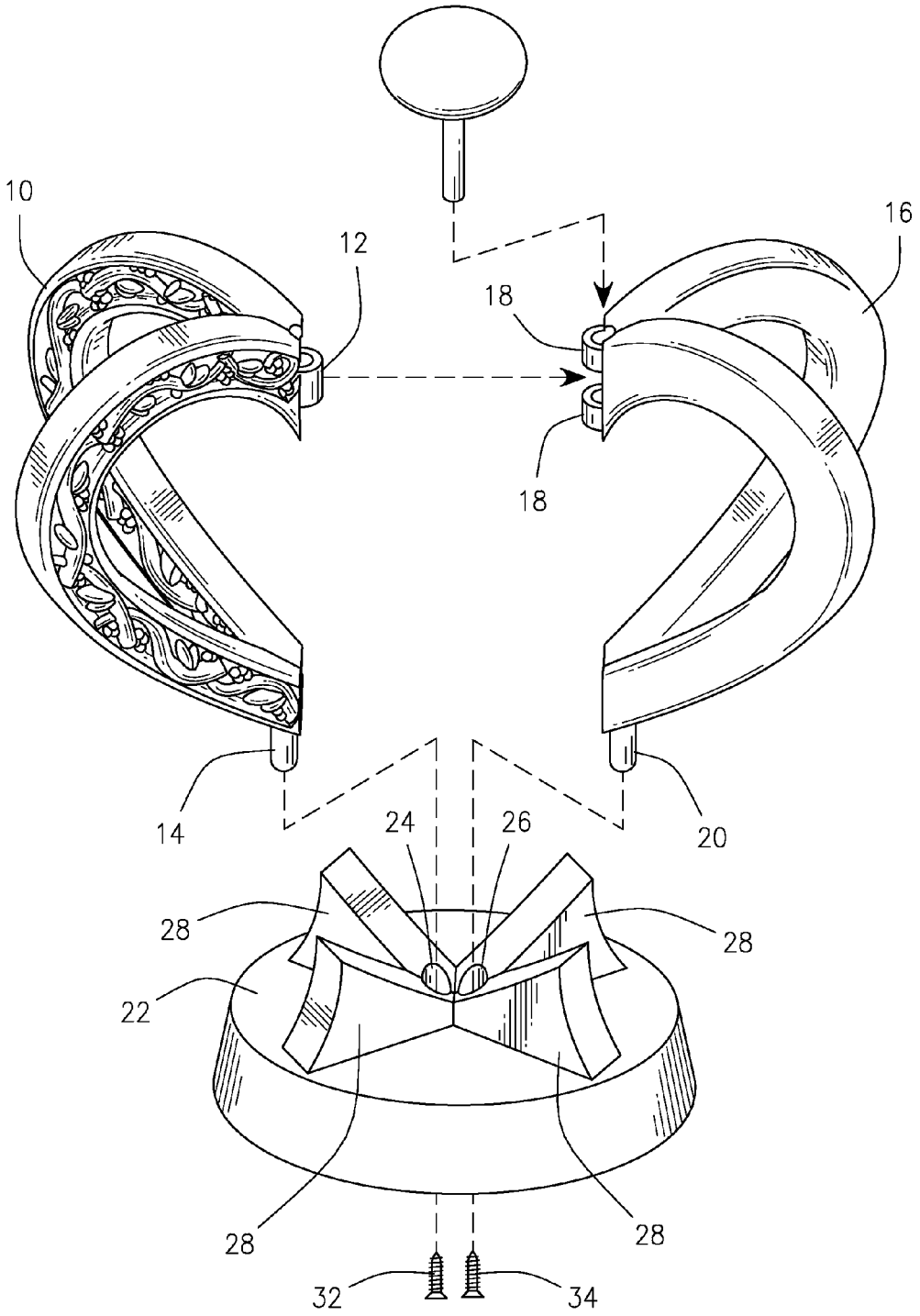
FIG. 1 illustrates an exploded view of the unity heart assembly constructed in accordance with the present invention.

As shown in FIG. 1, a first bent heart-shaped piece 10 may be brought to the ceremony by one of the parties. The first piece may be composed of a pair of half heart sections joined together in angular relation to each other. Piece 10 features an ornamental design and therefore typically represents the bride in a wedding ceremony. The ornamental first bent heart-shaped piece 10 may be composed of a sturdy plastic material and features a central open area. The ornamental bride's piece 10 may contain a barrel hinge 12 at the vertex of the heart in order to connect to the groom or plain bent heart-shaped piece 16 by way of a hinge connection. First piece 10 may also have a circular peg 14 that protrudes out of the bottom of the bent heart-shaped piece for alignment with an indented recess or hole 24 on the base piece 22 of the assembly.

Also shown in FIG. 1, a second bent heart-shaped piece 16 may be brought to the ceremony by another party. The second piece 16 may be composed of a pair of half heart sections joined together in angular relation to each other. Second piece 16 features a plain design and therefore typically represents the groom in a wedding ceremony. The plain bent heart-shaped piece 16 may be composed of a sturdy plastic material and features a central open area. The groom's, or plain, piece 16 main contain two barrels of a barrel hinge 18 at the vertex of the heart in order to connect to the bride or ornamental bent heart-shaped piece 10 by way of a hinge connection. Piece 16 may also have a circular peg 20 that protrudes out of the bottom of the bent heart-shaped piece for alignment with an indented hole 26 on the base piece 22 of the assembly.

Also shown in FIG. 1, a hollow base 22 contains two peg holes, 24 and 26 through the top surface in order for alignment with the first and second bent heart-shaped pieces, 10 and 16 respectively. One of the parties positions the first bent heart-shaped piece 10 onto the base 22 by placing the circular peg 14 into indented hole 24. Then the other party positions the second bent heart-shaped piece 16 onto the base 22 by placing the circular peg 20 into indented hole 26 contained on the base 22. The pegs 14 and 20 may be further secured to the base with screws 32, 34. Screw 32 may be inserted from the bottom of base 22 and aligned with peg 14. Similarly, screw 34 may be inserted from the bottom of base 22 and aligned with peg 20. Base 22 has four risers 28 that serve to cradle each heart onto base 22

Lastly, FIG. 1 shows the topper 30 that serves as a pin that goes through hinges 12 and 18, between the first bent heart shaped piece 10 and the second bent heart shaped piece 16. The topper 30 may be made out of a sturdy metal or plastic. The topper 30 may have a large flattened, circular area that may feature a variety of designs and serve to add aesthetic quality. The topper 30 may have an elongated ping like structure protruding perpendicularly and away from the flattened, circular portion. The elongated pin portion is the part that goes through hinges 12 and 18 between the first bent heart shaped piece 10 and the second bent heart shaped piece 16.

Figure 2:
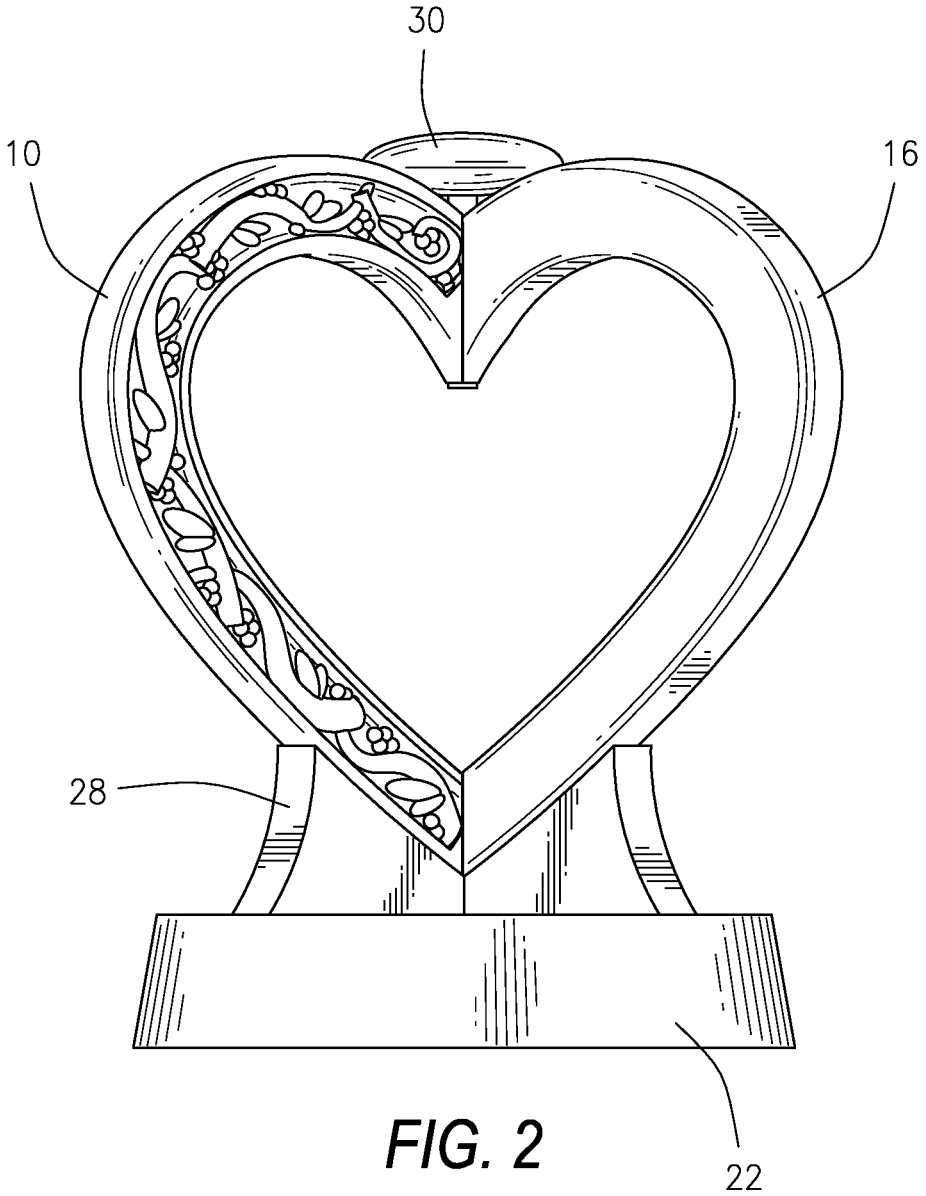
FIG. 2 illustrates a front view of the unity heart assembly after completion of the assembly.
Figure 3:
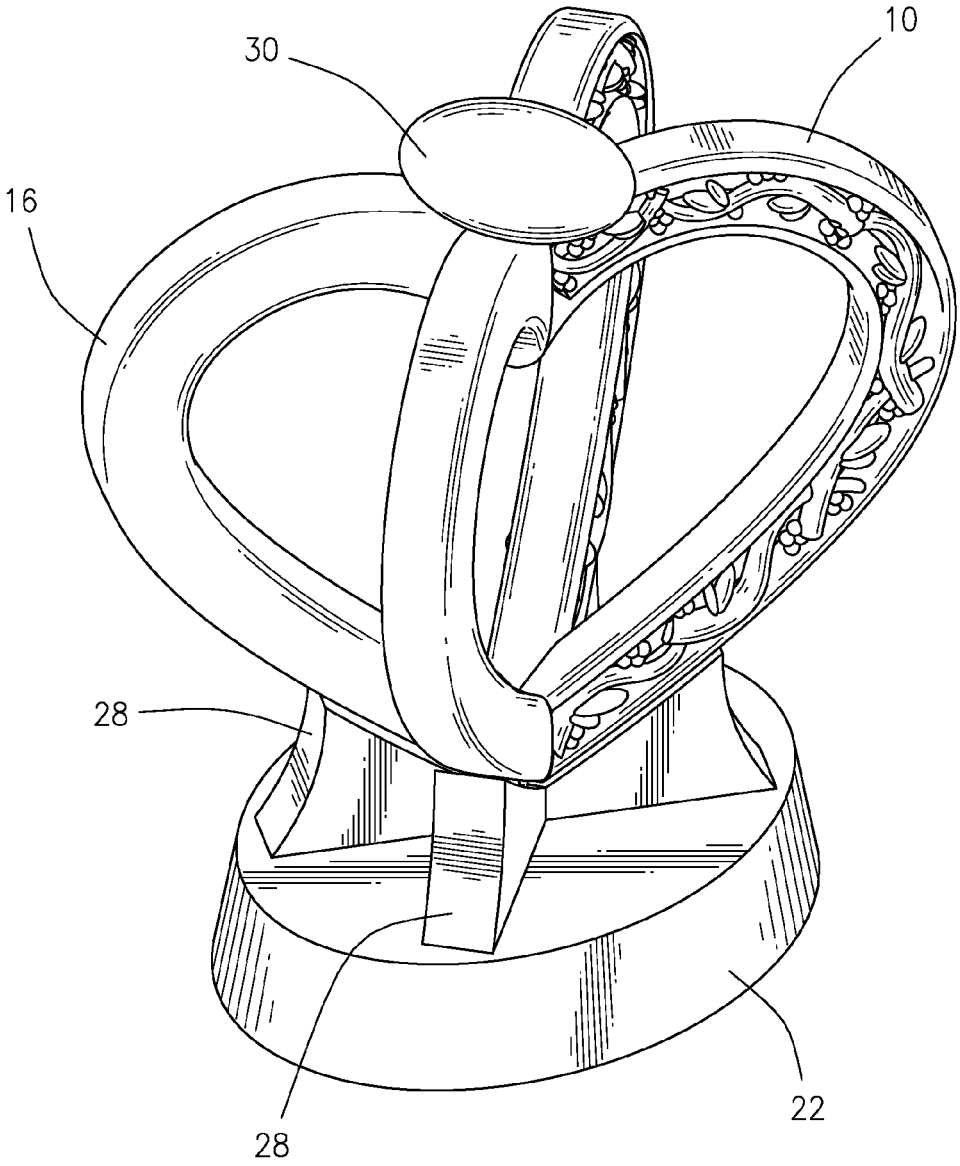
FIG. 3 illustrates a perspective view of a unity heart assembly after completion of the assembly.

FIG. 2 shows a front view of the completed unity heart assembly. FIG. 3 shows a perspective view of the completed assembly.

Figure 5:
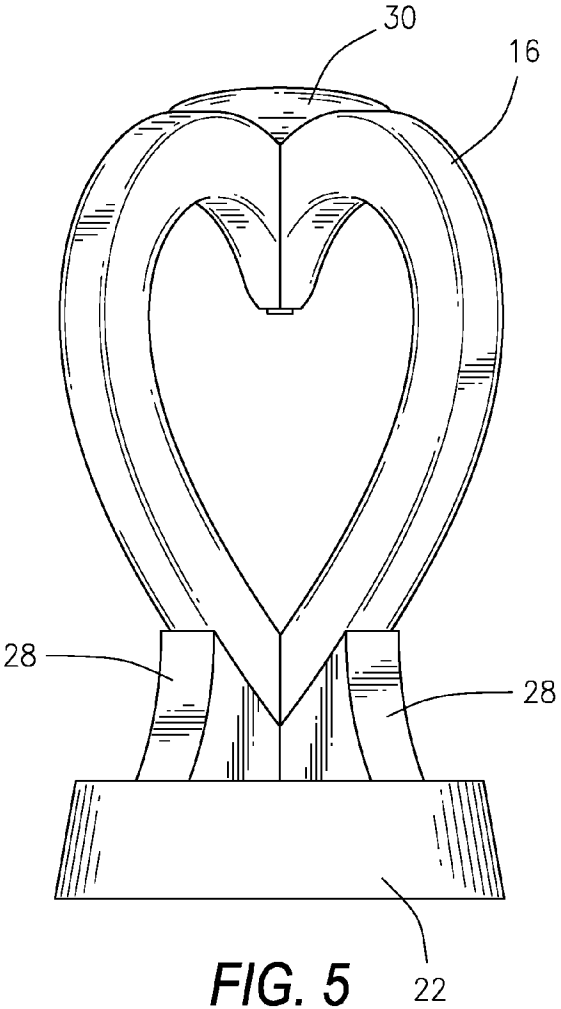
FIG. 5 illustrates a right side view of the unity heart assembly after the completion of the assembly.
Figure 4:
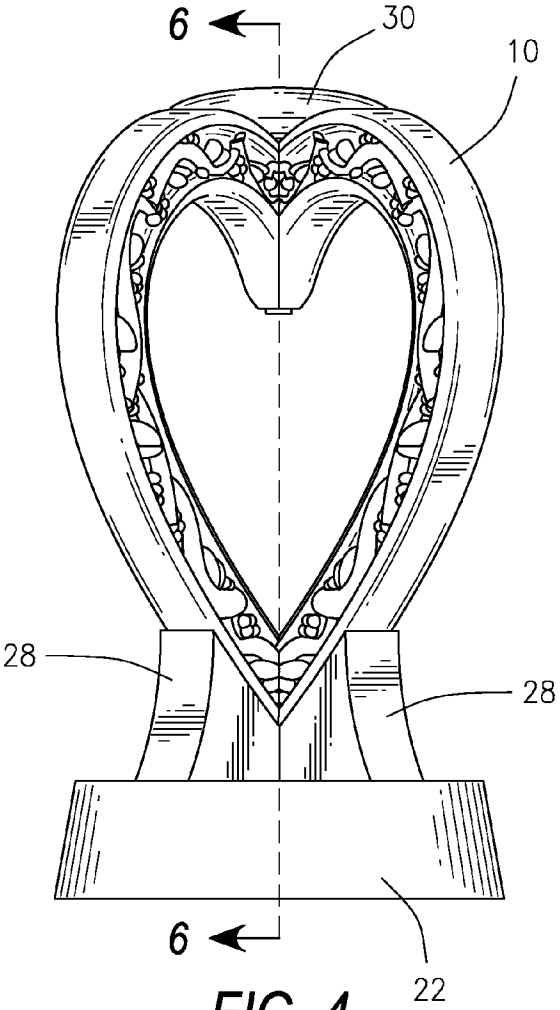
FIG. 4 illustrates a left side view of the unity heart assembly after completion of the assembly.

FIGS. 4 and 5 show a left side view of the completed assembly, and a right side view of the completed assembly, respectively. As can be seen in FIGS. 4 and 5, the side views of the heart assembly maintain the expression of a heart, and therefore when looking at the completed assembly from any angle, (front, back, left, or right) the shape of a heart is visible. The entire bride's ornamental bent-heart shaped piece can be seen in FIG. 4. The entire groom's bent heart-shaped piece is visible in Figure in 5.

Figure 6:
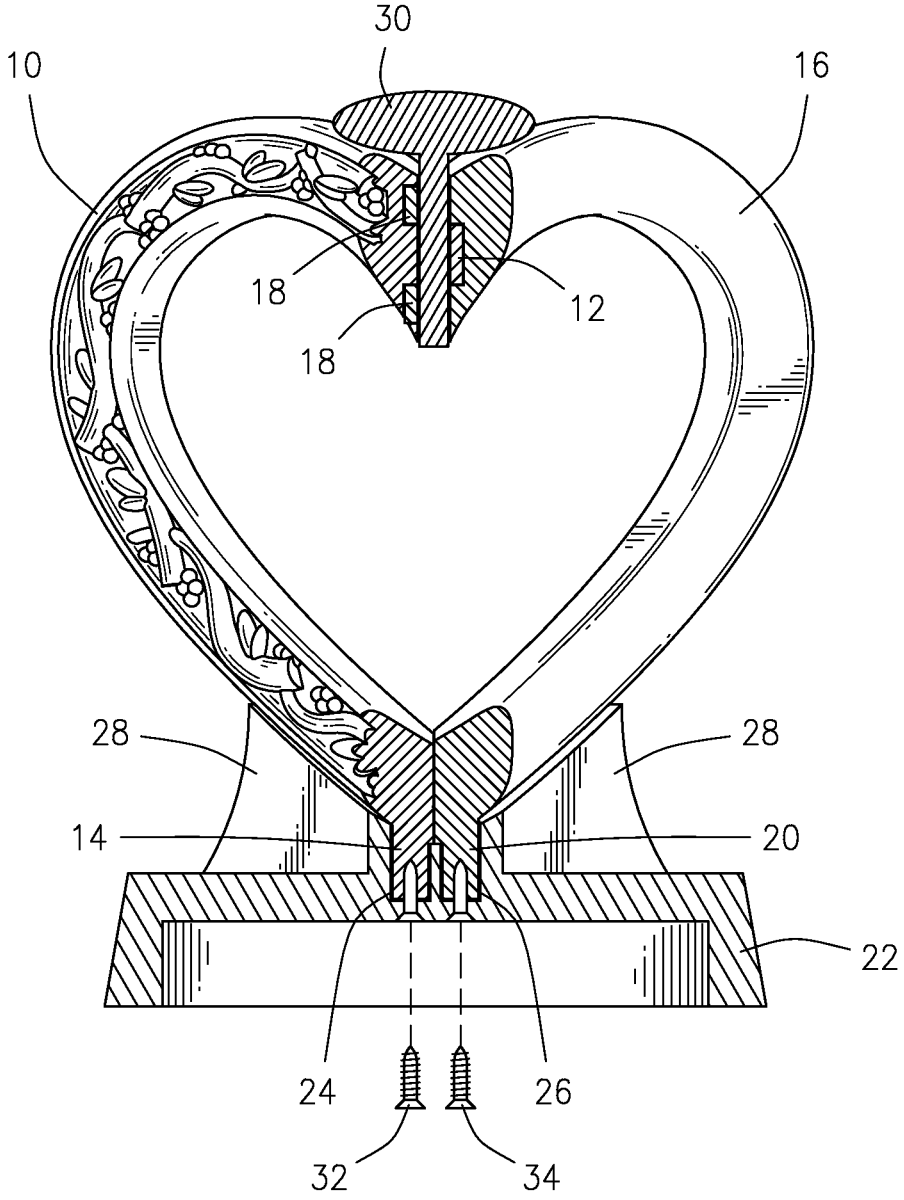
FIG. 6 illustrates a sectional view of the unity heart assembly taken along section line 6-6 of FIG. 4.

FIG. 6 illustrates a sectional view of the completed assembly along section line 6-6 in FIG. 4. The sectional view highlights the option to insert two screws 32 and 34 through of the bottom of base 22. The assembly may be turned over and screws 32 and 34 may be inserted into the bottom of the indented holes 24 and 26 of base 22. Each screw 32 and 34 enters from the bottom of base 22 and into pegs 14 and 20 which are attached to the first bent heart-shaped piece 10 and the second bent heart-shaped piece 16, respectively. Screws 32 and 34 serve to fasten and secure both the first bent heart-shaped piece 10 and the second bent heart-shaped piece 16 to the base 22 from the bottom of base 22. Also highlighted the sectional view of FIG. 5 is the topper 30 going through the hinge connections, 12 and 18, between the first bent heart-shaped piece 10 and the second bent heart-shaped piece 16 securing the two pieces, 10 and 16, together.

What is claimed is:

1. A method of assembling a ceremonial multi-piece sculpture representational of a union and commitment in a ritual-based ceremony, which comprises the steps of:

placing onto a base a first heart-shaped piece having a first upper vertex, a half of a hinge connection adjacent the first upper vertex, a first lower vertex, and a peg projecting downwardly from the first lower vertex;

wherein the first heart-shaped piece has a heart-shaped central open area in its center and is folded at an angle along an axis bisecting its upper and lower vertices; and wherein the peg of the first heart-shaped piece is securely fastened into a corresponding peg hole in the base;

placing onto the base a second heart-shaped piece having a second upper vertex, a half of a hinge connection adjacent the second upper vertex, a second lower vertex, and a peg projecting downwardly from the second lower vertex;

wherein the second heart-shaped piece has a heart-shaped central open area in its center and is folded at an angle along an axis bisecting its upper and lower vertices; and wherein the peg of the second heart-shaped piece is securely fastened into a corresponding peg hole in the base;

aligning said first and second heart-shaped pieces by interfitting together the first heart-shaped piece's half of a hinge connection with the second heart-shaped piece's half of a hinge connection to form a hinge connection between the first and second heart-shaped pieces and inserting a pin through said hinge connection to secure together said first heart-shaped piece and said second heart-shaped piece thereby completing said ceremonial multi-piece sculpture such that the ceremonial multi-piece sculpture forms and portrays a heart shape from all radial viewing angles.

2. A method of assembling a ceremonial multi-piece sculpture as set forth in claim 1, wherein said first heart-shaped piece is securely fastened with a screw from the bottom of the base extending from below the base up through the first heart-shaped piece's downwardly-projecting peg.

3. A method of assembling a ceremonial multi-piece sculpture as set forth in claim 1, wherein said second heart-shaped piece is securely fastened with a screw from the bottom of the base extending from below the base up through the second heart-shaped piece's downwardly-projecting peg.

4. A method of assembling a ceremonial multi-piece sculpture as set forth in claim 1 wherein said first bent heart-shaped piece contains ornamental designs.

5. A ceremonial multi-piece sculpture comprising:

a first heart-shaped piece having a first upper vertex, a half of a hinge connection adjacent the upper vertex, a first lower vertex, and a peg projecting downwardly from the lower vertex; wherein the first heart-shaped piece has a heart-shaped central open area in its center and is folded at an angle along an axis bisecting its upper and lower vertices;

a second heart-shaped piece having a second upper vertex, a half of a hinge connection adjacent the second upper vertex, a second lower vertex, and a peg projecting downwardly from the second lower vertex; wherein the second heart-shaped piece has a heart-shaped central open area in its center and is folded at an angle along an axis bisecting its upper and lower vertices;

a pin; and a base for receiving said first and second heart-shaped pieces and having two peg-shaped holes corresponding to the downwardly-projecting pegs of the first and second heart-shaped pieces;

wherein the peg of the first heart-shaped piece is securely fastened into a corresponding peg hole in the base and the peg from the second heart-shaped piece is securely fastened into a corresponding peg hole in the base; and wherein said first and second heart-shaped pieces are aligned and adjoined by interfitting together the first heart-shaped piece's half of a hinge connection with the second heart-shaped piece's half of a hinge connection to form a hinge connection between the first and second heart-shaped pieces and the pin is inserted through said hinge connection to secure together said first heart-shaped piece and said second heart-shaped piece such that the completed ceremonial multi-piece sculpture forms and portrays a heart shape from all radial viewing angles.

* * * * *